US011162490B2

(12) United States Patent
Leonov

(10) Patent No.: US 11,162,490 B2
(45) Date of Patent: Nov. 2, 2021

(54) BOREHOLE PUMP

(71) Applicant: OKLAS TECHNOLOGIES LIMITED LIABILITY COMPANY [RU/RU], Moscow (RU)

(72) Inventor: Vyacheslav Vladimirovich Leonov, Moscow (RU)

(73) Assignee: OKLAS TECHNOLOGIES LIMITED LIABILITY COMPANY, Moscow (RU)

( * ) Notice: Subject to any disclaimer, the term of this patent is extended or adjusted under 35 U.S.C. 154(b) by 53 days.

(21) Appl. No.: 16/608,193

(22) PCT Filed: Sep. 12, 2018

(86) PCT No.: PCT/RU2018/050113

§ 371 (c)(1),
(2) Date: Oct. 25, 2019

(87) PCT Pub. No.: WO2019/013675

PCT Pub. Date: Jan. 17, 2019

(65) Prior Publication Data

US 2021/0095660 A1 Apr. 1, 2021

(30) Foreign Application Priority Data

Jul. 12, 2017 (RU) ..... 2017124816

(51) Int. Cl.
*F04B 47/06* (2006.01)
*F04B 17/03* (2006.01)
*E21B 43/12* (2006.01)

(52) U.S. Cl.
CPC ..... *F04B 47/06* (2013.01); *E21B 43/128* (2013.01); *F04B 17/03* (2013.01)

(58) Field of Classification Search
CPC ..... F04B 17/03; F04B 47/06; F04B 47/00; E21B 43/128
(Continued)

(56) References Cited

U.S. PATENT DOCUMENTS 2,903,308 A * 9/1959 Barnhart ..... F16J 10/00 92/118
7,458,787 B2 * 12/2008 Brown ..... F04B 47/02 166/105
(Continued)

FOREIGN PATENT DOCUMENTS

EP 320859 A1 6/1989
RU 2235907 C1 9/2004
(Continued)

*Primary Examiner* — Charles G Freay
*Assistant Examiner* — Joseph S. Herrmann
(74) *Attorney, Agent, or Firm* — Nixon & Vanderhye PC

(57) ABSTRACT

The invention relates to the field of pumping equipment and can be used in the oil industry in the operation of marginal wells. A pump comprises a submersible electric motor with a protector. A drive of a working pump converts rotary motion into reciprocating motion. The working pump consists of a housing, an intake valve, a delivery valve, and a bypass valve, a main cylinder, and a hollow stepped plunger, the lower step of which is connected to a rod and has a diametral size that is smaller than the diametral size of the upper step. Below the main cylinder an additional cylinder is provided which accommodates the lower step of the hollow stepped plunger. The main cylinder is not rigidly fastened inside the housing. The fact that the main cylinder is not rigidly fastened allows it to self-align relative to the hollow stepped plunger, thus preventing jamming and increasing the operating reliability and the working life of the pump.

2 Claims, 1 Drawing Sheet

(58) Field of Classification Search
USPC ..... 417/415; 74/441
See application file for complete search history.

(56) References Cited

U.S. PATENT DOCUMENTS

| | | | | |
|---|---|---|---|---|
| 8,226,383 | B2 * | 7/2012 | Henry | F04B 47/06 417/422 |
| 9,028,229 | B2 * | 5/2015 | Bolt | F04B 47/12 417/555.2 |
| 2008/0080991 | A1 * | 4/2008 | Yuratich | F04B 43/10 417/390 |
| 2011/0168292 | A1 * | 7/2011 | Luzbetak | A61J 9/00 141/2 |
| 2013/0327207 | A1 * | 12/2013 | Sasscer | B64D 41/007 91/418 |
| 2015/0176574 | A1 * | 6/2015 | DeArman | F04B 47/12 417/53 |

FOREIGN PATENT DOCUMENTS

| | | | |
|---|---|---|---|
| RU | 139596 | U1 | 4/2014 |
| RU | 2532475 | C1 | 11/2014 |
| RU | 170784 | U1 | 5/2017 |

* cited by examiner

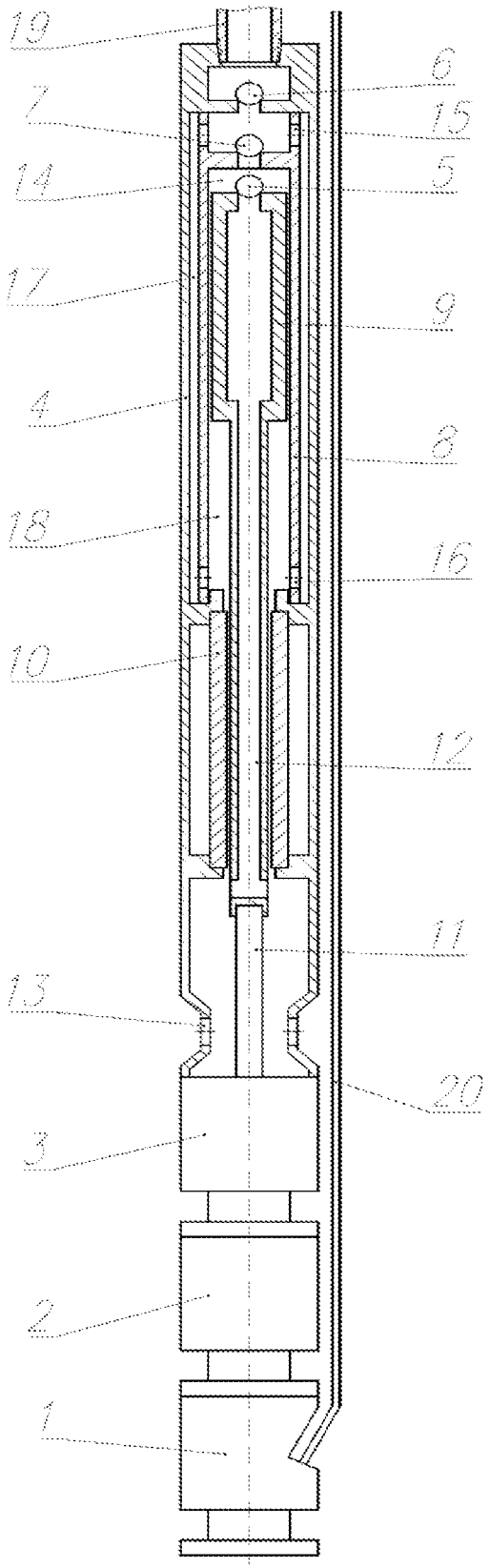
19
6
7
15
14
5
17
9
4
8
18
16
10
12
11
13
20
3
2
1

BOREHOLE PUMP

FIELD OF THE INVENTION

This application is a National Phase of International Application No. PCT/RU2018/050113 filed Sep. 12, 2018, which claims priority to Russian Application No. 2017124816 filed Jul. 12, 2017, the entire content of each of which is hereby incorporated by reference in this application.

The invention relates to the field of pump equipment and can be used in oil production industry in operation of marginal wells.

BACKGROUND OF THE INVENTION

A dual-action well pump is known, which comprises a submersible motor with hydraulic protection, a working pump drive converting rotary motion into a reciprocating motion, working pump consisting of working cylinder, hollow plunger connected with rod and pressure valve installed in it Cavity above hollow plunger is connected with annular space through suction valve, cavity under hollow plunger is connected with bypass line, formed by the shell, on the outer side of the enveloping working cylinder. Bypass line is connected with discharge line of pump Diameter of hollow plunger is greater than diameter of rod. Working cylinder is connected through coupling to successively connected housing of sealing unit and base of working pump drive. Rod of working pump drive serves as rod of working pump and passes inside housing of sealing unit The housing of the sealing assembly comprises at least one opening connecting the cylindrical surface of the drive rod of the working pump with the annular space and located at a distance from the upper end face of the working surface of the housing of the sealing assembly, which provides the necessary pressure difference between the outlet line of the pump and the annular space (according to the patent RU170784, cl F04B47/08, publ. Nov. 5, 2017).

The disadvantage of this pump is the intersection of the channels in the delivery and suction valves, which leads to increased hydraulic losses, which reduces the efficiency of the pump.

The closest technical solution is a well pumping unit including pump-compressor pipes, a plunger pump comprising a cylinder, a plunger, suction and discharge valves and driven by a drive, the drive rod is connected to the plunger and is sealed in the housing. The plunger is hollow and stepped, the lower step of which has a diameter smaller than the upper step and is sealed in the cylinder, forming an annular cavity, and the cylinder is tightly enclosed in the casing and provided with a transition cavity, communicating with above-plunger space through bypass valve, and with space of pump-compressor pipes through pressure valve. Transition cavity communicates with annular space along channel formed between casing and cylinder and holes Made in the lower part of the cylinder, and the suction valve is located in the upper part of the plunger (according to the patent RU2532475), cell F04B47/00, publ. Oct. 10, 2014).

The disadvantage of this installation is the sealing of the lower stage of the plunger, which, when working in the formation fluid containing the mechanical impurities, will quickly fail. And also, the difficulty of ensuring alignment of the stepped plunger with the cylinder and the surface of the seal, which can lead to the wedging of the pump.

SUMMARY OF THE INVENTION

The aim of the invention is to increase the service life of the plant.

EFFECT: increased reliability of operation of well pump and its service life.

The said technical result is achieved in that the well pump comprises a submersible motor with hydraulic protection, a working pump drive converting rotary motion into a reciprocating, working pump consists of a housing, an intake valve, a delivery valve, and a bypass valve, working cylinder, hollow stepped plunger whose lower stage is connected with rod and has diameter smaller than that of upper stage the working cylinder is provided with an additional cylinder accommodating the lower step of the hollow stepped plunger, and the working cylinder does not have a rigid attachment inside the housing.

BRIEF DESCRIPTION OF THE DRAWINGS

The invention is illustrated in the FIGURE, which shows a downhole pump.

DETAILED DESCRIPTION OF THE INVENTION

An embodiment of a downhole pump (see the FIGURE) comprises kinematically interconnected submersible electric motor 1 with hydraulic protection 2, working pump drive 3 and working pump consisting of housing 4, suction valve 5, discharge valve 6 and bypass valve 7, working cylinder 8, hollow stepped plunger 9, whose lower stage is located in additional cylinder 10 and is connected to rod 11 (possibility for both rigid and hinged connections).

Hollow stepped plunger 9 has channel 12 which is connected through holes 13 with annular space, and through suction valve 5 with above-plunger suction cavity 14.

The above-plunger suction cavity 14 through bypass valve 7, holes 15 and 16, annular channel 17 made between housing 4 and working cylinder 8 is connected with annular pressure chamber 18.

Annular pressure chamber 18 is formed between working cylinder 8 and lower stage of hollow stepped plunger 9.

The pump in the well is secured to the tubing string 19. The power of the motor is supplied via a cable 20.

The downhole pump operates as follows.

When pump is lowered into the well, formation fluid under the action of hydrostatic pressure of formation through holes 13, 15, 16, channel 12, valves 5 and 7 fills inner cavities 14, 17, 18 of the pump. Through discharge valve 6, the formation fluid enters the tubing string 19.

When submersible electric motor 1 is turned on, its torque through the hydraulic protection 2 kinematically connected thereto is transmitted to the drive of the working pump 3, which converts a rotary movement of the electric motor 1 into a reciprocating movement of the drive rod 11 of the working pump 3. The rod 11 drives the hollow stepped plunger 9.

When the hollow stepped plunger 9 is moved downward, the suction valve 5 opens and the formation fluid passes through the orifices 13 and the channel 12 into the suction cavity 14. At the same time, the formation fluid from the annular pressure chamber 18 passes through the openings 16 and 15, the annular channel 17 opens the discharge valve 6 and enters the tubing string 19. Herewith, the bypass valve 7 is closed.

When hollow stepped plunger 9 moves upward, suction valve 5 closes and part of formation fluid through bypass valve 7, holes 16 and 15, annular channel 17 enters pressure chamber 18, and the other part enters into tubing string 19 through discharge valve 6. Volume of liquid supplied to tubing string 19 is equal to difference between volumes of suction line 14 and pressure chamber 18.

Cycle is repeated during operation of the pump.

The use of an additional cylinder 10 in the pump, which does not significantly increase the axial dimension of the pump, increases its reliability in many cases, since the wear rate of the cylinder is considerably less than the wear rate of the seal, which is used in analogues. This allows pump for a long time to maintain tightness and to effectively pump formation fluid from a well.

The lack of a rigid mounting of working cylinder 8 makes it possible to self-center relative to hollow stepped plunger 9, which prevents its wedging and increases reliability of the pump. Also, the manufacture of the pump is more efficient since there is no strict requirement for the axial alignment of the stages of the plunger 9.

Thus, the solutions used in the invention make it possible to increase reliability of the operation of the well pump and the service life thereof.

The invention claimed is:

1. A borehole pump, comprising:

a submersible motor with a hydraulic protector, a drive of a working pump configured to convert a rotary motion into a reciprocating motion, the working pump including a housing, a suction valve, a discharge valve, a bypass valve, a working cylinder, and a hollow stepped plunger having a lower stage and an upper stage, wherein the lower stage is connected to a rod and has a diametrical size smaller than the diametrical size of the upper stage, wherein the working pump further includes an additional cylinder arranged under the working cylinder, the lower stage of the hollow stepped plunger is located inside the additional cylinder, and the working cylinder is centered inside the housing relative to the hollow stepped plunger by a portion of the housing that is located radially between the working cylinder and the lower stage of the hollow stepped plunger.

2. The borehole pump according to claim 1, wherein the rod communicates the reciprocating motion of the drive to the hollow stepped plunger.

* * * * *